United States Patent [19]

Poling et al.

[11] Patent Number: 4,835,348

[45] Date of Patent: May 30, 1989

[54] ELECTRICAL SWITCH DEVICE

[75] Inventors: Ronald W. Poling, Morrison; James P. Frank, Rock Falls, both of Ill.

[73] Assignee: General Electric Company, Fort Wayne, Ind.

[21] Appl. No.: 165,127

[22] Filed: Mar. 7, 1988

[51] Int. Cl.[4] ..... H01H 5/18; H01H 9/16; H01H 9/26

[52] U.S. Cl. ..... 200/5 EA; 200/408; 200/302.2; 200/308

[58] Field of Search ..... 200/5 E, 67 E, 67 B, 200/67 C, 67 DB, 67 PK, 68.1, 317, 308, 5 EA, 67 D, 302

[56] References Cited

U.S. PATENT DOCUMENTS 3,407,276 10/1968 Pescetto ..... 200/67 B
4,045,632 8/1977 Pierrot ..... 200/67 PK
4,159,563 7/1979 Bauer et al. ..... 200/67 E
4,362,910 12/1982 Boebel et al. ..... 200/5 EA

*Primary Examiner*—Roy N. Envall, Jr.
*Attorney, Agent, or Firm*—Ralph E. Krisher, Jr.

[57] ABSTRACT

An electrical switch device has a casing with a viewing aperture therein, and switch actuating means is pivotally movable in the casing between an at-rest position and a switch actuating position. A toggle spring is movable with the switch actuating means for resiliently opposing its pivotal movement from both the at-rest and switch actuating positions. The toggle spring includes visual indicating means conjointly movable therewith for disposition in a viewable position at the viewing aperture in response to the pivotal movement of the switch actuating means from its at-rest position to its switch actuating position.

14 Claims, 2 Drawing Sheets

ELECTRICAL SWITCH DEVICE

FIELD OF THE INVENTION

This invention relates in general to electrical switch devices and in particular to a push button actuated electrical switch device.

BACKGROUND OF THE INVENTION

In the past, various different types of push button switches have been provided for controlling the electric circuitry of various apparatus, such as for instance domestic appliances or the like. In at least some of the aforementioned past push button switches utilized in domestic appliances, an actuating lever was engaged in abutment with a switch element, and in response to a force applied onto the actuating lever, the actuating lever and the switch element were conjointly movable so as to initially "lift" a movable contact on the switch element from its making engagement with a cooperating stationary contact. Thereafter, a toggle spring arrangement was effective to impart snap action to the movement of the switch element subsequent to the breaking of the movable contact from the stationary contact. At least one of the disadvantageous or undesirable features of the aforementioned past push button switch is believed to be that the movable contact was "lifted" from the stationary contact by the conjoint movement of the abutted together actuating lever and switch element. For instance, since the snap action movement of the switch element was subsequent to the "lifting" of the movable contact from its making engagement with the stationary contact, it is believed that the movable contact could be "teased" by tapping th push button of the actuating lever. Tapping the push buttons, i.e. quick repetitive applications of an operator applied force onto the push buttons, is believed to have resulted in the quick repetitive breaking of the movable contact from the stationary contact and the remaking thereof which, of course, might have subjected such contacts to welding.

SUMMARY OF THE INVENTION

Among the several objects of the present invention may be noted the provision of an improved electrical switch device which overcomes at least some of the above discussed disadvantageous and undesirable features, as well as others, of the prior art; the provision of such improved electrical switch device having switch means with genuine or true snap action movement through its entire travel between a plurality of switching modes thereof; the provision of such improved electrical switch device having improved means for visually indicating to the operator the particular switching mode of the switch elements; the provision of such improved electrical switch device in which the component parts thereof are of a simplistic design, easily assembled and economically manufactured. These, as well as other objects and advantageous features of the present invention, will be in part apparent and in part pointed out hereinafter.

In general, an electrical switch device in one form of the invention has a casing with at least one viewing aperture therein. At least one switch means movable with snap action in the casing is operable generally for switching between a plurality of switching modes, and at least one toggle spring means is movable in said casing for imparting the snap action movement to the switch means to effect the operation of the at least one switch means between its switching modes. The at least one toggle spring means includes visual indicating means conjointly movable with the at least one toggle spring means for disposition in a viewable position at least generally adjacent the at least one viewing aperture so as to be viewable therethrough when said at least one switch means in a preselected one of its switching modes.

Further in general and in one form of the invention, an electrical switch device has a casing with at least one viewing aperture therein. At least one switch actuating means is arranged in the casing for pivotal movement between an at-rest position and a switch actuating position, and at least one toggle spring means is movable in the casing with the at least one switch actuating means and biased into engagement with the at least one switch actuating means for opposing its movement from both the at-rest position and the switch actuating position. The at least one toggle spring means includes visual indicating means conjointly movable therewith for disposition in a viewable position at least generally adjacent said at least one viewing aperture in response to the pivotal movement of the at least one switch actuating means from its at-rest position to its switch actuating position and for disposition in a displaced position spaced away from the at least one viewing aperture in response to the pivotal movement of the at least one switch actuating means from its switch actuating position to its at-rest position.

BRIEF DESCRIPTION OF THE DRAWINGS

Corresponding reference characters refer to corresponding parts throughout the several views of the drawings.

The exemplifications set out herein illustrate a preferred embodiment of the invention in one form thereof, and such exemplifications are not to be construed as limiting either the scope of the disclosure or the scope of the invention in any manner.

DETAILED DESCRIPTION OF THE PREFERRED EMBODIMENT

Figure 1:
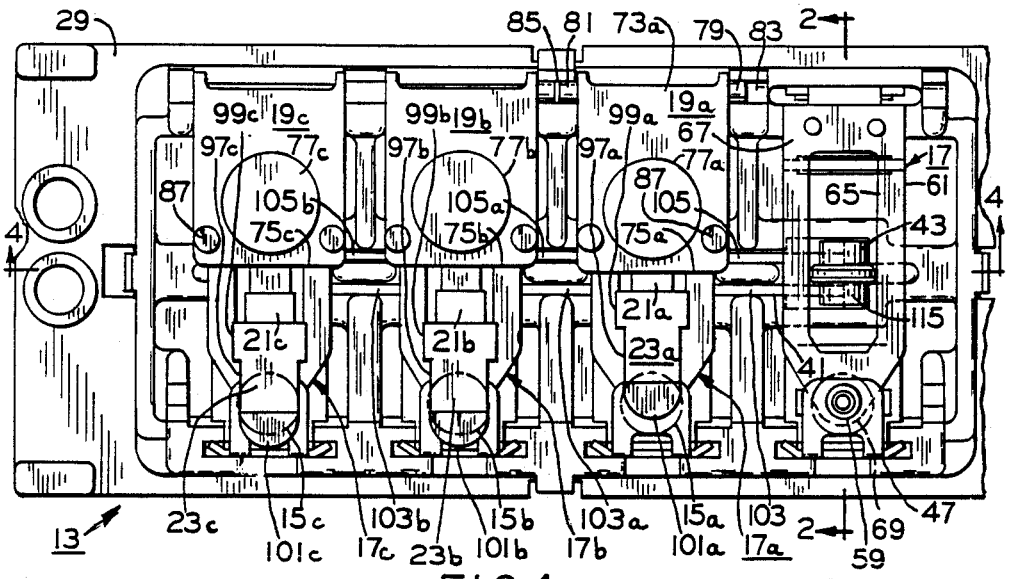
FIG. 1 is a top elevational view of an electrical switch device in one form of the invention with parts of the electrical switch device broken away to more clearly illustrate other parts thereof.
Figure 4:
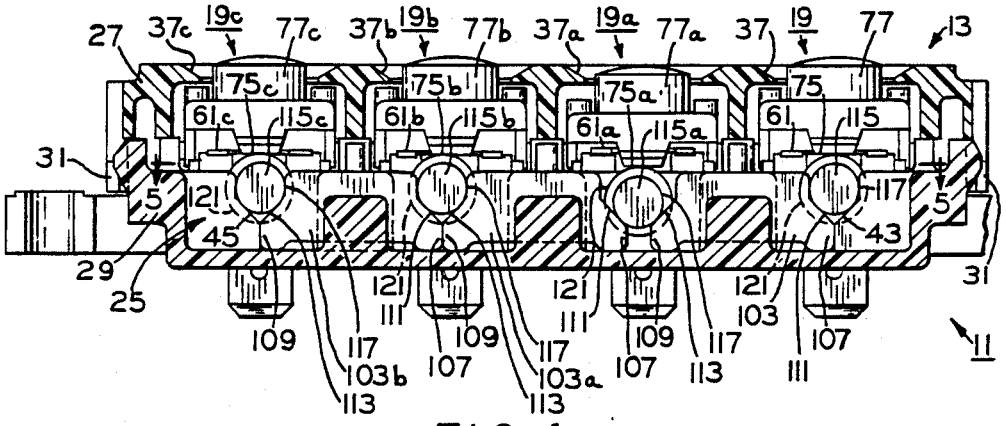
FIG. 4 is a sectional view taken along line 4—4 in FIG. 2.
Figure 2:
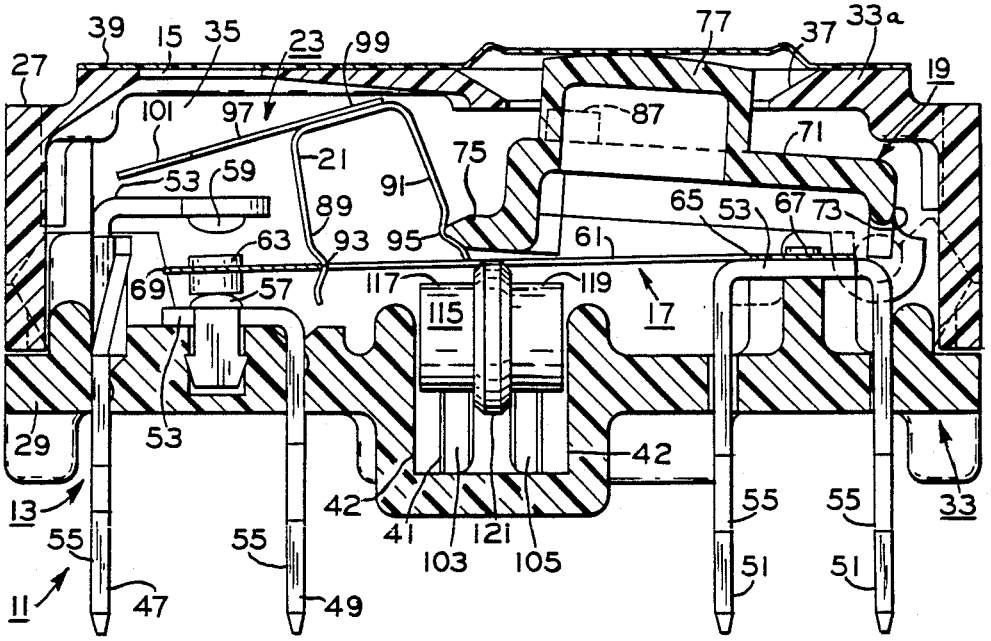
FIG. 2 is a sectional view taken along line 2—2 in FIG. 1 and illustrating components of the electrical switch device in one switching mode.
Figure 3:
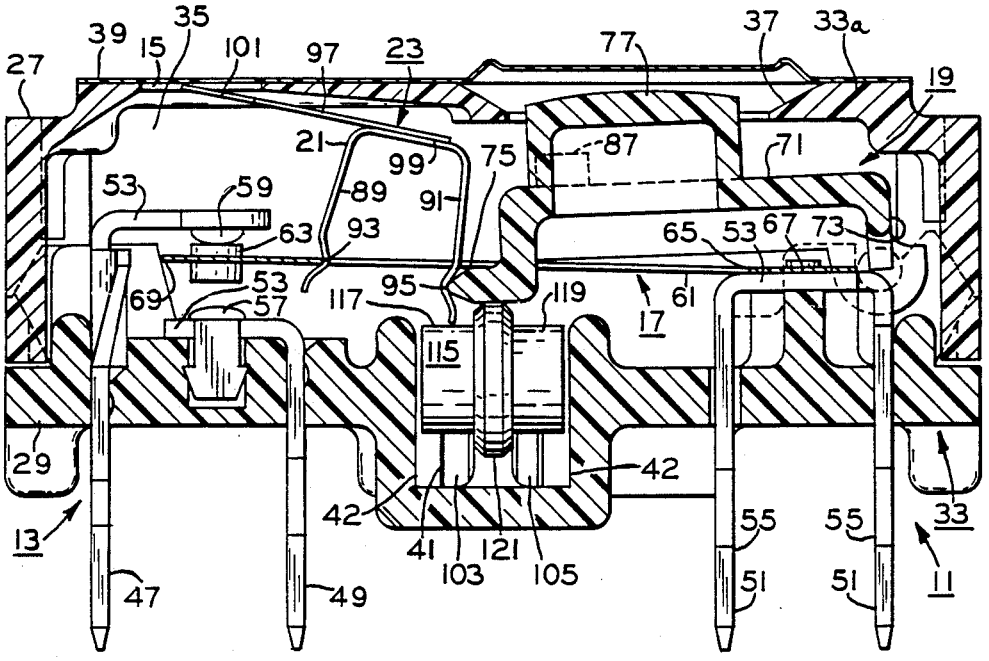
FIG. 3 is generally the same as FIG. 2 but illustrating the components of the electrical switch device in another switching mode.

With reference to the drawings in general, there is illustrated in one form of the invention an electrical switch device, such as a push button switch 11 for instance, which has a casing or housing 13 with a set of viewing apertures 15, 15*a*, 15*b*, 15*c* therein (FIG. 1). A set of switch means 17, 17*a*, 17*b*, 17*c* arranged generally in laterally spaced apart relation in casing 13 are operable generally with snap action for switching between a plurality of switching modes, respectively (FIGS. 1–3). A set of actuating means or switch actuating means 19, 19*a*, 19*b*, 19*c* are also arranged generally in laterally spaced apart relation and are selectively pivotally movable from an at-rest position toward a switch means actuating position or pivoted position for effecting the selective operation of switch means 17–17*c* from one of the switching modes to another of the switch modes thereof, respectively (FIGS. 1–3). A set of toggle springs or toggle spring means 21, 21*a*, 21*b*, 21*c* are interposed between actuating means 19–19*c* and switch means 17–17*c* so as to be movable therewith for imparting the snap action to the operation of the switch means between the switching modes thereof, and the toggle springs include a set of visual indicating means 23, 23*a*, 23*b*, 23*c* movable from a displaced position spaced away from viewing apertures 15–15*c* so as to be hidden from view therethrough toward a viewable position at least generally adjacent the viewing apertures so as to be viewable therethrough in response to the selective pivotal movement of the actuating means from the at-rest position to the pivoted position thereof, respectively (FIGS. 2 and 3). Return means, as indicated generally at 25, is operable generally in response to the selective movement of one of the actuating means 19–19*c* from its at-rest position to its pivoted position for effecting the return pivotal movement to the pivoted position of another of the actuating means disposed in its pivoted position, and one of toggle springs 21–21*c* is movable in response to the return pivotal movement of the another actuating means to effect the movement of one of visual indicating means 23–23*c* from its viewable position to its displaced position, respectively (FIGS. 2–4).

More particularly and with specific reference to FIGS. 1–3, casing 13 is provided with mating or interfitting casing parts or members 27, 29 which may be formed of any suitable dielectric material, such as for instance a resin or the like, and when secured together or joined in assembly relation, the casing parts are retained against displacement by suitable means, such as for instance a set of releasable resilient or spring latches or latching arrangements shown at 31. While spring latches 31 are illustrated herein for purposes of disclosure, it is contemplated that various other means, such as for instance riveting, clamping or laser welding or the like, for retaining casing parts 27, 29 against displacement may be utilized within the scope of the invention so as to meet at least some of the objects thereof. Furthermore, while casing parts 27, 29 are shown herein as generally in the form of a base plate and cover, it is contemplated that the casing parts may have other forms, such as for instance mating half sections or the like, within the scope of the invention so as to meet at least some of the objects thereof. Casing parts 27, 29 are provided with a plurality of integrally interconnected walls or wall means, indicated generally at 33, and when the casing parts are assembled together, the walls define a chamber 35 within casing 13. Viewing apertures 15–15*c* are provided in laterally spaced apart relation through one casing wall 33*a* so as to communicate with chamber 35, and another set of apertures or openings 37, 37*a*, 37*b*, 37*c* are also provided in laterally spaced apart relation through casing wall 33*a* so as to communicate with the chamber, the viewing apertures 15–15*c* and openings 37–37*c* also being predeterminately spaced from each other.

If desired, a touch panel 39 formed of any suitable pliable sheet material, such as for instance polycarbonate or the like (approximately seven mils thick), may be secured to casing wall 33*a* exteriorly thereof by suitable means well known to the art to prevent the entry of foreign particles or liquids through viewing apertures 15–15*c* and openings 37–37*c* into casing chamber 35. Of course, at least those parts of touch panel 39 which overlay viewing apertures 15–15*c* are generally transparent for viewing therethrough visual indicating means 23–23*c*, as further discussed hereinafter. A generally elongate groove or groove means 41 for accommodating return means 25, as discussed in greater detail hereinafter, is provided in another casing wall 33*b* so as to communicate with chamber 35, and casing wall 33*b* is disposed generally in spaced apart and opposed relation with casing wall 33*a*. Groove means 41 extends generally transversely across chamber 35 and actuating means 19–19*c* herein, and a pair of opposed ends or end walls of the groove means define at least in part opposed cam surfaces 43, 45 on casing 13. To complete the description of casing 13, a plurality of opposed slots 42, 42*a*, 42*b*, 42*c* are provided in the casing intersecting with the opposed sidewalls of the casing between end wall cam surfaces.

Although only one set of terminals 47, 49, 51 are shown in FIGS. 2 and 3 and described hereinafter for purposes of drawing simplification and brevity of disclosure, a plurality of such terminal sets are arranged in laterally spaced apart relation in casing 13 to accommodate switch means 17–17*c*. Terminals 47, 49, 51 may be formed of any suitable metallic material having the desired physical and electrical characteristics, such as for instance a brass or tin plated steel or the like, and the terminals are secured in preselected positions in casing wall 33*b* against displacement therefrom by suitable means, such as for instance staking or being molded in situ in the casing wall or the like. Each terminal 47, 49, 51 is provided with a switch means supporting section 53 within chamber 35, and the supporting sections 53 of terminals 47, 49 are arranged generally in spaced apart and overlaying relation with each other in the chamber. Each terminal 47, 49, 51 is also provided with at least one electrical connector section 55 which extends exteriorly of casing wall 33*b*; however, at least terminal 51 may be provided with a plurality of the electrical connector sections, as seen in FIGS. 2 and 3. Terminals 47, 49, 51 are arranged to accommodate switch means 17 which is of the single pole, double throw type; however, with the elimination of one of terminals 47, 49, it is contemplated that switch means of the single pole single throw type may be utilized in electrical switch device 11 within the scope of the invention so as to meet at least some of the objects thereof.

Since switch means 17–17*c*, actuating means 19–19*c*, toggle spring means 21–21*c* and visual indicating means 23–23*c* are respectively of like constructions and are operable in the same manner, only the constructions and operation of switch means 17, actuating means 19, toggle spring means 21 and visual indicating means 23 are described in detail hereinafter for purposes of brevity of disclosure; however, like component parts of such switch means, actuating means, toggle spring means and visual indicating means are indicated with the differentiating letters a, b and c whenever referred to hereinafter.

Switch means 17 includes a pair of generally opposed stationary contacts or contact means 57, 59 secured to supporting sections 53 of terminals 47, 49 by suitable means, such as soldering, welding or staking or the like, and a generally elongate resilient switch element 61 having a movable or double contact or contact means 63 thereon. Switch element 61 may be formed of any suitable material having the desired physical and electrical properties, such as for instance a beryllium copper or the like, and a generally elongate opening 65 is provided through the switch element between a pair of generally opposite ends or end portions 67, 69 thereof. One opposite end 67 of switch element 61 is secured by suitable means, such as for instance riveting, soldering or crimping or the like, in electrical contacting engagement to supporting section 53 of terminal 51, and the other opposite end 69 of the switch element is disposed between opposed supporting sections 53 of terminals 47, 49 thereby to position double contact 63 for switching or electrical contacting engagement with opposed stationary contacts 57, 59 on opposed supporting sections 53 of terminals 47, 49.

Actuating means 19 includes an actuating lever 71 having a pair of opposite pivoted and free ends or end portions 73, 75, and means, such as for instance a push button 77 or the like, for receiving an operator applied force is integrally formed on the actuating lever between the pivoted and free ends thereof. A pair of generally oppositely extending trunnions 79, 81 are integrally provided on actuating lever 71 at least generally adjacent pivoted end 73 thereof, and the trunnions are journaled in a pair of bearing supports, such as partial bearing surfaces 83, 85 for instance, provided therefor on casing 13 within chamber 35. When actuating lever 71 is in its at-rest position, as best seen in FIG. 2, push button 77 is disposed at least in part within cooperating opening 37 therefor in casing wall 33*a* so as to engage with a part of touch panel 39 extending across the opening, and a stop or abutment means 87 integral with the push button is engaged with a part of casing wall 33*a* extending about the opening thereby to define the at-rest position of the actuating lever. Actuating lever 71 may be formed of any suitable dielectric material, such as for instance a resin or the like.

Toggle spring 21 has a generally U-shaped configuration and a pair of generally laterally spaced apart opposite ends or end portions 89, 91 with a pair of detents or indentations 93, 95 adjacent said opposed end portions, as best seen in FIGS. 2 and 3. Opposite end 89 of toggle spring 21 projects through elongate slot 65 in switch element 61, and indentation 93 in opposite end 89 is biased into engagement with a part of the switch element within the slot generally adjacent opposite end 67 of the switch element. Indentation 95 in opposite end 91 of toggle spring 21 is biased into engagement with free end 75 of actuating lever 71, and as best seen in FIG. 2, the compressive force exerted by the toggle spring pivotally urges actuating lever 71 toward its at-rest position engaging stop 87 with casing wall 33*a* and will also pivotally urge switch element 61 about its pivoted opposite end 67 so as to make double contact 63 in engagement with stationary contact 57 thereby to define one of the switching modes of switch means 17. Toggle spring 21 may be formed from a generally elongate strip of any suitable material having the desired physical properties, such as for instance a spring steel or the like, for imparting snap action movement to switch means 17 and actuating means 19, as discussed in greater detail hereinafter.

Visual indicating means 23 includes a generally elongate arm or arm means 97, such as for instance a strip of resin film or a metallic strip or the like, having a pair of generally opposite ends or end portions 99, 101. Opposite end 99 of arm 97 is secured to a part of toggle spring 21 by suitable means, such as for instance a pressure sensitive adhesive or welding or the like, so that the arm and toggle spring are conjointly movable, and the other opposite end, such as free or distal end or end portion 101 for instance, of the arm may be provided with a coloration, if desired, so as to enhance the viewing thereof through viewing aperture 15 when visual indicating means 23 is in its viewable position.

Figure 5:
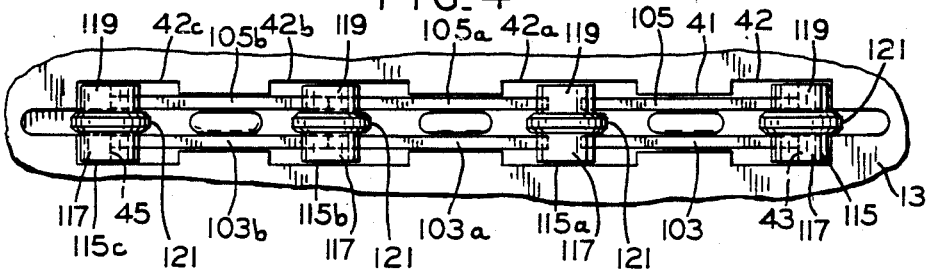
FIG. 5 is a partial sectional view taken along line 5—5 in FIG. 4.

Return means 25 comprises a pair of sets of cam means 103, 103*a*, 103*b* and 105, 105*a*, 105*b* laterally spaced apart and arranged generally in end-to-end relation in casing groove 41 so as to be reciprocally movable or slidable in guided relation between opposed end wall cam surfaces 43, 45 of the groove, respectively, as best seen in FIGS. 4 and 5. Cams 103–103*b*, 105– 105*b* are respectively provided with a pair of opposite abutment ends or end portions 107, 109 and a pair of opposite cam surfaces 111, 113. While cam surfaces 111, 113 are arranged generally at an angle of about forty five degrees (45°) with respect to abutment ends 107, 109, it is contemplated that the angularity of the cam surfaces may be varied within the scope of the invention so as to meet at least some of the objects thereof. A set of cam followers or cam following means, such as for instance rollers 115, 115*a*, 115*b*, 115*c* or the like, are respectively provided with a pair of generally opposite cylindric or cam surfaces 117, 119 for camming engagement with adjacent opposed cam surfaces 111, 113 of cams 103–103*a*, 105–105*a* and/or cam surface ends 43, 45 of groove 41, and a generally annular extension or rim 121 is also provided on each cam follower 115–115*a* intermediate the opposite cylindric surfaces so as to extend therebeyond for driving and driven engagement with actuating means 19–19*c*, respectively, as discussed in greater detail hereinafter.

In the operation of electrical switch device 11, assume that switch means 17, actuating means 19, toggle spring 21 and visual indicating means 23 are respectively in the positions thereof shown in FIG. 2. When an operator applied force is selectively applied or exerted on push button 77 of actuating lever 71 through touch panel 39, the actuating lever is pivotally moved about its pivoted end 73 in a counterclockwise direction from the at-rest position of the actuating lever, as best seen in FIG. 2, toward the pivoted position thereof, as best seen in FIG. 3. The operator applied force necessary to effect the counterclockwise pivoted movement of actuating lever 71 typically may be in the range of between about 1.5 pounds to about 2.5 pounds, and the pivotal movement of the actuating lever typically may be generally about 0.050 inches. Of course, the counterclockwise pivotal movement of actuating lever 71 is opposed by the compressive force of toggle spring 21; however, the actuating lever and toggle spring are conjointly movable with the toggle spring being pivoted or rotated about the engagement of indentation 93 in opposite end 89 of the toggle spring with switch element 61 within elongate slot 65. As free end 75 of actuating lever 71 and opposite end 91 of toggle spring 21 pass at least in part through elongate slot 65 in switch element 61 in response to the aforementioned conjoint pivotal movement of the actuating lever and the toggle spring, the negative spring gradient of the toggle spring is effective to impart snap action pivotal movement to switch element 61, and upon this snap action pivotal movement of the switch element, double contact 63 thereon is moved from its making engagement with stationary contact 57 into making engagement with stationary contact 59 thereby to define another switching mode of switch means 17, as best seen in FIG. 3. Thus, in response to the counterclockwise pivotal movement of actuating lever 71 from its at-rest position toward its pivoted position, toggle spring is rotated from one opposite operable position, as shown in FIG. 2, to another opposite operable position, as shown in FIGS. 3. It is well known to the art that a toggle spring is provided with a negative spring gradient so as to afford snap action movement to the component being driven by such toggle spring upon the movement thereof between opposite operable positions.

With actuating lever 71 in its at-rest position and toggle spring 21 in its aforementioned one opposite operable position, as shown in FIG. 2, distal end portion 101 of arm 97 on the toggle spring is disposed in its displaced position spaced away from viewing aperture 15 so as to be hidden from view therethrough. However, when toggle spring 21 is rotated into its aforementioned another opposite operable position, as discussed above and as shown in FIG. 3, arm 97 is conjointly movable or rotated with the toggle spring so as to dispose distal end portion 101 of the arm in its viewable position at least generally adjacent viewing aperture 15 so as to be viewable therethrough. When visual indicating means 23 is so disposed in its viewable position with respect to viewing aperture 15, an operator is provided with a positive visual indication with respect to the switching mode of switch means 17.

Since actuating lever 71 is engaged adjacent its free end 75 with annular rim 121 of cam follower 115, the counterclockwise pivotal movement of the actuating lever from its at-rest position toward its pivoted position is also effective to drive or move the cam follower downwardly in its casing slot 42, and this downward movement of the cam follower drivingly engages its opposite extensions 117, 119 with end wall cam surface 43 in casing groove 41 and cam surfaces 111 opposed thereto on cams 103, 105. In response to the camming engagement of cam follower 115 with end wall cam surface 43 and cam surfaces 111 on cams 103, 105, cams 103, 105 are conjointly driven or translated leftwardly in casing groove 41, as best seen in FIG. 5, so as to engage their abutment ends 109 with adjacent opposed abutment ends 107 on cams 103*a*, 105*a* thereby to also move at least cams 103*a*, 105*a* leftwardly in casing groove 41. Of course, translatory movement of other cams 103*b*, 103*c* and 105*b*, 105*c* may be effected in casing groove 41 through the abutment of adjacent opposite ends 107, 109 thereof in response to the translatory movement of cams 103*a*, 105*a* so as to cam one of cam followers 115*a*–115*c* upwardly in one of their casing grooves 42*a*–42*c* to return one of actuating levers 71*a*–71*c* from it pivoted position toward its at-rest position, as discussed in greater detail hereinafter with respect to actuating lever 71. Of course, one of switch means 17*a*–17*c* is movable with snap action from its another switching mode to its one switching mode in response to the return pivotal movement of the aforementioned one of actuating levers 71*a*–71*c*.

When actuating lever 71 is in its pivoted position with free end 75 thereof urged by toggle spring 21 toward engagement with rim 121 of cam follower 115, as previously described and as shown in FIG. 3, another one of actuating levers 71*a*–71*c* may be pivotably moved from its at-rest position to its pivoted position to effect the snap action movement of an associated one of switch means 17*a*–17*c* from its one switching mode to its another switch mode. Of course, one of cam followers 115*a* –115*c* is moved downwardly in one of casing slots 42*a*–42*c* conjointly with the aforementioned pivotal movement of one of actuating levers 71*a*–71*c* from its at-rest position to its pivoted position to effect the translatory movement of at least one of cams 103–103*b* and 105–105*b* in casing groove 41. In response to this translatory movement, opposite cylindric extensions 117, 119 on cam follower 115 are engaged with cam surface 111 of cams 103, 105 and end wall cam surface 43 in casing groove 41 so as to be cammed upwardly in casing slot 42.

Since annular rim 121 of cam follower 115 is engaged with free end 75 of actuating lever 71 in its pivoted position, as mentioned above, the upward movement of cam follower 115 in casing slot 42 effects the return pivotal movement of the actuating lever in the clockwise direction from its pivoted position, as best seen in FIG. 3, to its at-rest position, as best seen in FIG. 2. Actuating lever 71 is pivoted about its pivoted end 73 in casing 13 during the return pivotal movement of the actuating lever, and the biased together opposite end 91 of toggle spring 21 and free end 75 of the actuating lever pass through elongate slot 65 in switch element 61 as toggle spring is rotated from its other operable position (as best seen in FIG. 3) to its one operable position (as best seen in FIG. 2) generally about the engagement of toggle spring opposite end 89 with the switch element within the elongate slot thereof. As toggle spring 21 is so moved between its operable positions, the toggle spring imparts snap action movement to switch element 61 thereby to disengage double contact 63 from stationary contact 59 and reengage the double contact with stationary contact 57. When toggle spring 21 is returned to the operable position thereof shown in FIG. 2, it urges actuating lever 71 toward its at-rest position with snap action thereby reengaging stop 87 with casing wall 33*a* generally about opening 37 therein. To complete the description of the operation of electrical switch device 11, arm 97 of visual indicating means 23 is conjointly movable with toggle means to its operable position shown in FIG. 2 thereby to move distal end 101 from its viewable position to its displaced position with respect to viewing aperture 15.

From the foregoing, it is now apparent that a novel electrical switch device 11 has been disclosed for accomplishing the objects set out hereinabove, as well as others, and that changes as to the precise arrangements, details and connections of the component parts of such electrical switch device may be made by those having ordinary skill in the art without departing from the spirit of the invention or the scope thereof as set out in the claims which follow.

What we claim as new and desire to secure by Letters Patent of the United States is:

1. An electrical switch device comprising:

a casing including a set of wall means for defining a chamber in said casing, a set of viewing apertures in one of said wall means and communicating with said chamber, and a set of openings in said one wall means spaced from said viewing apertures and communicating with said chamber, respectively;

a plurality of sets of terminals arranged generally in laterally spaced apart relation in another of said wall means disposed generally in opposed spaced apart relation with said one wall means, each terminals including at least one electrical connector section extending exteriorly of said casing, and a supporting section disposed within said chamber, and a pair of said terminals in each terminal set having said support sections thereof spaced apart in overlaying relation;

a pair of opposed contacts on said support sections of each of said terminal pairs;

a set of resilient switch elements arranged generally in laterally spaced apart relation in said chamber and movable between a plurality of switching positions in said chamber, each switch element including a pair of generally opposite ends, a generally elongate slot extending through said each switch element between said opposite ends, one of said opposite ends being secured in circuit relation to said supporting section of another one of said terminals in each terminal set, and contact means disposed at least adjacent the other of said opposite ends for selective engagement with said opposed contacts;

a set of actuating levers arranged generally in laterally spaced apart relation in said chamber and pivotally movable between an at-rest position and a pivoted position, respectively, each actuating lever including a pivoted end pivotally supported within said chamber, a free end generally opposite said pivoted end, push button means between said pivoted and free ends and at least in part disposed within one of said openings for receiving an operator applied force, and stop means extending from said push button means for engagement with said one wall means about said one opening thereby to define the at-rest position of said actuating lever;

a set of toggle spring means biased between said free ends of said actuating levers and said switch elements within said elongate slots thereof so as to be movable with said actuating levers and said switch elements and operable generally for urging said actuating means toward the at-rest positions thereof and for urging said switch elements toward one of the switching positions thereof engaging said contact means with one of said opposed contacts, said toggle spring means including a set of arm means secured to said toggle spring means for conjoint movement therewith, and a set of distal portions on said arm means disposed in positions displaced from view through said viewing apertures when said actuating levers are in the at-rest positions thereof, respectively, one of said actuating levers being pivotally movable from the at-rest position to the pivoted position thereof in response to a selective application of the operator applied force on one of said push button means so as to move one of said toggle spring means and effect the movement of one of said switch elements from its one switching position into the other of its switching positions thereby to disengage said contact means from said one opposed contact and engage said contact means with the other of said opposed contacts, and one of said arm means being conjointly movable with said one toggle spring means to move one of said distal portions from the displaced position thereof toward a viewable position at least generally adjacent one of said viewing apertures so as to be viewable therethrough when said one actuating lever is moved into its pivoted position; and means in said chamber and operable generally in response to the operator applied force pivotal movement of another one of said actuating levers from the at-rest position to the pivotal position thereof for pivotally returning said one actuating means from the pivoted position to the at-rest position thereof, said one toggle spring means being movable with said one actuating lever in response to the pivotal return to its at-rest position so as to effect the movement of said one distal portion on said one arm means from its viewable position to its displaced position and also the movement of said one switch element from its other switching position to its one switching position thereby to disengage said contact means from said other contact and reengage said contact means with said one contact.

2. An electrical switch device comprising:

a casing including a set of viewing apertures therein;

a set of switch means arranged generally in laterally spaced apart relation in said casing and operable generally with snap action for switching between a plurality of switching modes, respectively;

a set of actuating means arranged generally in laterally spaced apart relation in said casing and selectively pivotally movable from an at-rest position toward a pivoted position for effecting the selective operation of said switch means from one of the switching modes to another of the switching modes thereof, respectively;

a set of toggle spring means interposed between said actuating means and said switch means so as to be movable therewith for imparting the snap action to the operation of said switching means between the switching modes thereof, said toggle spring means including a set of visual indicating means movable from a displaced position spaced away from said viewing apertures so as to be hidden from view therethrough toward a viewable position at least generally adjacent said viewing apertures so as to be viewable therethrough in response to the selective pivotal movement of said actuating means from the at-rest position to the pivoted position thereof, respectively; and return means operable generally in response to the selective pivotal movement of one of said actuating means from its at-rest position to its pivoted position for effecting the return pivotal movement to the at-rest position of another of said actuating means disposed on its pivoted position, one of said toggle spring means being movable in response to the return pivotal movement of said another actuating means to effect the movement of one of said visual indicating means from its viewable position to its displaced position.

3. An electrical switch device comprising:

a casing including at least one viewing aperture therein, and at least one opening therein;

at least one switch means movable with snap action in said casing for switching between a plurality of switching modes;

at least one actuating means for pivotal movement in one direction and another direction opposite the one direction in said casing, said at least one actuating means including means disposed at least in part in said at least one opening for receiving an operator applied force to effect the pivotal movement of said at least one actuating means in the one direction; and at least one toggle spring means movable in said casing and biased between said at least one actuating means and said at least one switch means for effecting the snap action movement of said at least one switch means into a preselected one of the switching modes in response to the pivotal movement in the one direction of said at least one actuating means, and said at least one toggle spring means including visual indicating means conjointly movable therewith for disposition at least generally adjacent said at least one viewing aperture so as to be viewable therethrough when said at least one switch means is in its preselected one switching mode.

4. The electrical switch device as set forth in claim 3 wherein said visual indicating means includes arm means secured to said at least one toggle spring means for the conjoint movement therewith, and a distal portion on said arm means disposed in a position at least generally adjacent the viewing aperture so as to be viewable therethrough when said at least one switch means is in its preselected one switching mode.

5. The electrical switch device as set forth in claim 3 wherein said at least one actuating means further includes means for abutment with said casing at least generally adjacent said at least one opening therein for limiting the pivotal movement in the another direction of said at least one actuating means.

6. The electrical switch device as set forth in claim 3 further comprising at least another opening in said casing, at least another actuating means for pivotal movement in one direction and another direction opposite the one direction, said at least another actuating means including another means disposed at least in part in said at least another opening for receiving an operator applied force to effect the pivotal movement of said at least another actuating means in the one direction, and means in said casing and operable generally in response to the pivotal movement of said at least another actuating means for effecting the return pivotal movement in the opposite direction of said at least one actuating means, said at least one toggle spring means being movable in response to the return pivotal movement of said at least one actuating means to effect the movement of said visual indicating means toward a displaced position spaced away from said at least one viewing aperture so as not to be viewable therethrough and to also effect the movement with snap action of said at least one switch means from the preselected one switching mode into another switching mode thereof.

7. The electrical switch device as set forth in claim 3 wherein said at least one toggle spring means further includes a pair of generally laterally spaced apart free end portions, one of said free end portions being biased into engagement with said at least one switch means, said at least one actuating means further including a pair of generally opposite ends, one of said opposite ends being pivotally arranged with said casing and the other of said free end portions on said at least one toggle spring means being biased into engagement with the other of said opposite ends of said at least one actuating means.

8. An electrical switch device comprising:

a casing including at least one viewing aperture therein;

at least one switch means movable with snap action in said casing and operable generally for switching between a plurality of switching modes; and at least one toggle spring means movable in said casing for imparting the snap action movement to said at least one switch means to effect the operation of said at least one switch means between its switching modes, said at least one toggle spring means including visual indicating means conjointly movable with said at least one toggle spring means for disposition in a viewable position at least generally adjacent said at least one viewing aperture so as to be viewable therethrough when said at least one switch means is in a preselected one of its switching modes.

9. The electrical switch device as set forth in claim 8 wherein said visual indicating means comprises arm means for securement to said at least one toggle spring means and having a distal portion disposed in the viewable position when said at least one switch means is in its preselected one switching mode.

10. An electrical switch device comprising:

a casing including at least one viewing aperture therein;

at least one switch actuating means arranged in said casing for pivotal movement between an at-rest position and a switch actuating position; and at least one toggle spring means movable in said casing with said at least one switch actuating means and biased into engagement with said at least one switch actuating means for resiliently opposing its pivotal movement from both the at-rest position and the switch actuating position, said at least one toggle spring means including visual indicating means conjointly movable therewith for disposition in a viewable position at least generally adjacent said at least one viewing aperture in response to the pivotal movement of said at least one switch actuating means from its at-rest position to its switch actuating position and for disposition in a displaced position spaced away from said at least one viewing aperture in response to the pivotal movement of said at least one switch actuating means from its switch actuating position to its at-rest position.

11. The electrical switch device as set forth in claim 10 wherein said casing further includes at least one opening therein, and said at least one switch actuating means further including means disposed at least in part in said at least one opening for receiving an operator applied force to effect the pivotal movement of said at least one switch actuating means from its at-rest position to its switch actuating position.

12. The electrical switch device as set forth in claim 11 wherein said receiving means includes means for abutment with said casing at least generally adjacent said at least one opening thereby to define the at-rest position of said at least one switch operating means.

13. The electrical switch device as set forth in claim 10 wherein said at least one switch actuating means includes means for abutment with said casing thereby to define the at-rest position of said at least one switch actuating means.

14. The electrical switch device as set forth in claim 10 further comprising at least another switch actuating means arranged in said casing for pivotal movement between an at-rest position and a switch actuating position, and means in said casing and operable generally in response to the pivotal movement of said at least another switch actuating means from its at-rest position to its switch actuating position for effecting the return pivotal movement of said at least one switch actuating means from its switch actuating position to its at-rest position.

* * * * *